US010029452B2

(12) United States Patent
Lehnhoff

(10) Patent No.: US 10,029,452 B2
(45) Date of Patent: Jul. 24, 2018

(54) METHOD FOR PRODUCING DECORATIVE PRINTS HAVING IDENTICAL QUALITY INDEPENDENTLY OF THE PRINTING METHOD USED AND A DEVICE FOR PERFORMING SAID METHOD

(71) Applicant: Flooring Technologies Ltd., Pieta (MT)

(72) Inventor: Ingo Lehnhoff, Dierhagen (DE)

(73) Assignee: Flooring Technologies Ltd., Kalkara (MT)

( * ) Notice: Subject to any disclaimer, the term of this patent is extended or adjusted under 35 U.S.C. 154(b) by 0 days.

(21) Appl. No.: 14/774,464

(22) PCT Filed: Mar. 14, 2014

(86) PCT No.: PCT/EP2014/055071
§ 371 (c)(1),
(2) Date: Sep. 10, 2015

(87) PCT Pub. No.: WO2014/140252
PCT Pub. Date: Sep. 18, 2014

(65) Prior Publication Data

US 2016/0023453 A1 Jan. 28, 2016

(30) Foreign Application Priority Data

Mar. 14, 2013 (EP) ..... 13159174

(51) Int. Cl.
*B41F 33/00* (2006.01)
*B41F 17/00* (2006.01)
(Continued)

(52) U.S. Cl.
CPC ..... *B41F 17/00* (2013.01); *B41M 1/10* (2013.01); *B41M 5/00* (2013.01); *B41C 1/05* (2013.01); *E04F 15/02* (2013.01)

(58) Field of Classification Search
CPC ..... B41M 3/18
(Continued)

(56) References Cited

U.S. PATENT DOCUMENTS 5,455,681 A * 10/1995 Ng ..... G06K 15/1266 345/428
6,509,903 B1 * 1/2003 Yosefi ..... H04N 1/58 345/597
(Continued)

FOREIGN PATENT DOCUMENTS

CA 2300891 A1 3/1999
CN 1826231 A 8/2006
(Continued)

OTHER PUBLICATIONS

Klaus-Detlef Freyer: "Farbmanagement and Rastererhalt in einem Proof", Druckspiegel, Druckspiegel Verlagsgesellschaft, Heusenstamm, DE, No. 1, Jan. 1, 2003, pp. 20-22.

*Primary Examiner* — Anthony Nguyen
(74) *Attorney, Agent, or Firm* — The Webb Law Firm

(57) ABSTRACT

A method for producing decorative prints having identical quality on at least two carrier materials includes the following steps: providing at least one print motif; converting the at least one print motif into at least one high resolution electronic data set; reducing the resolution of the at least one high resolution electronic data set; creating at least one first print decor on at least one first carrier material by means of the at least one resolution reduced electronic data set; creating at least one print cylinder for a gravure printing process by using at least one resolution reduced electronic data set, with the resolution reduced electronic data set identical to or different from the resolution reduced electronic data set used for the digital printing; and creating at
(Continued)

least one second print decor on at least one second carrier material by using the at least one print cylinder.

17 Claims, 2 Drawing Sheets

(51) Int. Cl.
*B41M 1/10* (2006.01)
*B41M 5/00* (2006.01)
*B41C 1/05* (2006.01)
*E04F 15/02* (2006.01)

(58) Field of Classification Search
USPC ..... 101/483
See application file for complete search history.

(56) References Cited

U.S. PATENT DOCUMENTS 7,519,231 B2 * 4/2009 Li ..... G06T 7/12 382/264
7,519,235 B1 * 4/2009 Georgiev ..... G06T 3/40 382/260
2002/0108521 A1 * 8/2002 Velde ..... G06K 15/02 101/483
2004/0089184 A1 * 5/2004 Lampinski ..... A63B 45/02 101/483
2007/0095224 A1 5/2007 Brehm et al.
2007/0127064 A1 * 6/2007 Kuroshima ..... G06F 3/1204 358/1.15
2007/0266877 A1 11/2007 Oldorff
2011/0068509 A1 * 3/2011 Perrier ..... B41C 1/05 264/400
2012/0176433 A1 7/2012 Aumuller et al.
2013/0088556 A1 * 4/2013 Hagspiel ..... B44C 5/043 347/110

FOREIGN PATENT DOCUMENTS

CN 102015190 A 4/2011
CN 102917888 A 2/2013
DE 19736605 A1 2/1999
EP 1858244 A1 11/2007
WO 2011029539 A1 3/2011
WO 2011129757 A1 10/2011

* cited by examiner

METHOD FOR PRODUCING DECORATIVE PRINTS HAVING IDENTICAL QUALITY INDEPENDENTLY OF THE PRINTING METHOD USED AND A DEVICE FOR PERFORMING SAID METHOD

CROSS-REFERENCE TO RELATED APPLICATIONS

This application is the United States national phase of International Application No. PCT/EP2014/055071 filed Mar. 14, 2014, and claims priority to European Patent Application No. 13159174.5 filed Mar. 14, 2013, the disclosures of which are hereby incorporated in their entirety by reference.

BACKGROUND

The present invention relates to a method for producing decorative prints and a device for performing said method.

Carrier materials provided with a decor, as for instance wood-based boards, are typically used as flooring element or for covering walls and ceilings. In the past the wood-based boards used as carrier materials for this purpose where mostly coated with a décor paper, whereby the diversity of different pattern décor papers were and are not limited.

As an alternative for using décor papers on wood-based boards the direct printing of wood-based boards as carrier materials has been developed in the past since a printing of paper and its subsequent laminating or direct coating on the wood-based board is omitted.

The printing techniques mainly used hereby are the gravure printing process and the digital printing process. The gravure printing process is a printing technique, in which the elements to be imaged are present as deepening in a print form, which is colored before printing. The print color is especially located in the deepening and is transferred due to the contact pressure of the printing form and adhesion forces onto the object to be printed as for instance a carrier material. In contrast in case of digital printing the print image is transferred directly from a computer to a printing machine as for instance a laser printer or an ink jet printer. Thereby the use of a static print form is omitted.

In the course of the technical development of the print technology of different carrier materials the digital printing is however more and more used. While digital printing processes were at first used in particular in the graphic industries as for instance advertisement agencies, advertising material manufacturers and print shops it has been shown in the meantime that digital printing processes are also more often found in other industry branches. There are a lot of different reasons for this, wherein however two essential arguments are recognized. The digital printing allows the production of a print image with a particular high quality due to higher resolution and allows furthermore a broader application range at high flexibility.

The disadvantage of higher costs of the digital printing technology per print, in particular in comparison to conventional printing methods, as for instance the gravure printing or offset printing takes thereby more and more the backseat.

Despite the multiple advantages the technical better and more demanding digital print has also problems, which are in particular present if intentional or unintentional combinations with other printing processes occur at products.

This can cause confusions already in the first product steps, for instance when a suitable décor is out sorted or selected by a costumer. If for instance a décor is sorted out or presented at a cylinder engraver or in a design studio at first as digital print with a corresponding high resolution of for instance 600 dpi (dots per inch) and subsequently for said décor an engraved décor print cylinder for the cylinder slot provides only still a resolution of about 60 to about 80 dpi then the two prints will show significant difference in a visual comparison.

An approach for solving this problem is presented in EP 1 858 244. The method described there allows the production of the same décor on two different carrier materials using an uniform starting data set, wherein the décor is printed at first on a first carrier material as reference print with an ink jet printer in a first printing line in digital printing and parallel or subsequently the same décor is printed on a second carrier material by means of a print cylinder in a gravure printing process in a second printing line. Accordingly at least one identical digital starting data set is used for out sorting or producing a reference print by a digital printer and when engraving print cylinders.

Digital printing is carried out today almost exclusively using the color system CMYK. The CMYK color model is a subtractive color model, wherein the abbreviation CMYK stands for the three color ingredients cyan, magenta, yellow and the black component key as color depth. A color space (gamut) can be mapped with said color system, which suffices multiple requirements from different areas. In any case, the CMYK color space is a compromise, which provides that specific colors cannot be generated at all or additionally the use of additional colors is still required. This can result in color deviations, when a décor is transferred from a digital printing process to a gravure printing process even though the same data set is used for the digital print as well as for the cylinder engraving. This problem is in particular prevalent where a lot of yellow and brown colors have to be generated during printing as in the reproduction of wood décors in the furniture and laminate floor industry.

This can be counteracted by using the same pigments for the digital printer and for the gravure printing. The manufacturer of wood-based boards provided with décors is still faced with this not yet solved problem.

Furthermore, on the one hand products shall become cheaper by mass production and on the other hand a larger variety is expected by the costumer, which is mirrored for instance in an almost endless décor variety. A considerable problem is thereby a prediction, which a manufacturer for instance of decorative surfaces for consumer goods such as laminate floors has to make regarding the question which new decors are excepted by the customers and which not.

When redesigning a collection a manufacturer of decorative plates has to buy a minimum quantity of printed décor paper or printed finish films of each décor. The minimum quantity of paper is typically in the range of about one ton, what corresponds to about 15.000 $m^2$. This décor paper has to be impregnated subsequently, to be pressed on carrier boards and further processed. If now exactly this décor is not successful on the market, remaining quantities are obtained on all value added levels, which cannot be used any further. The economical damage arising therefrom is considerable. In addition the color setting of the décor is determined at least for the one ton of paper.

A possibility to solve this problem would be the production of all decors exclusively as digital print. This however has the severe disadvantage that these decors are considerably more expensive in respect to the printing costs. Furthermore the higher quality level of the décors due to the higher resolution of the digital print could devaluate other non-digital printed decors and could thus provide a sales loss of conventional printed carrier materials.

An increasing trend is the lot size, which steadily decreases. The digital printing technology can take this trend in general into account. Due to the high flexibility of the digital print, it is possible to not only print directly paper or film webs, but also to print directly carrier boards such wood-based boards. Herewith some value added levels can be skipped on the way of further refinement to semi-finished or finished products as for instance furniture boards, laminate floors or façade boards, what provides a further flexibilisation and simplification of the production process.

A particular challenge is thereby a combination of different print processes, since until now visible differences occur in case of a desired or undesired combination of high quality digital printing in comparison to other printed processes. These differences are than often seen and claimed as quality defects.

SUMMARY OF THE INVENTION

The technical object of the present invention was thus to provide a method for producing décor prints on carrier materials with the same quality or comparable quality and in particular independent on the digital or analog creation of the décor.

This object is solved according to the invention by a method as described herein and a device for performing said method as described herein.

Accordingly a method for producing décor prints having identical quality on at least two carrier materials is provided, wherein the quality of the décor prints is independent on the printing method used, in particular independent on the question if the used printing method is a digital print or an analog print, such as gravure print.

DETAILED DESCRIPTION

Additional details and advantages of the present invention will become apparent upon review of the following Detailed Description with reference to the accompanying figure.

The present method according to the invention comprises the steps a) Providing at least one print motif;

b) Converting the at least one print motif into at least one high resolution electronic data set having a resolution of up to 1200 dpi, preferably 1000 dpi, by means of at least one image processing software;

c) reducing the resolution of the at least one high resolution electronic data set down to 100 dpi, preferably 60 to 80 dpi, by means of at least one image processing software;

d) creating at least one first print décor on at least one first carrier material by using at least one digital printer by means of the at least one resolution reduced electronic data set;

e) Creating of at least one print cylinder for a gravure print process by using at least one resolution reduced electronic data set, and f) Creating at least one second print décor on at least one second carrier material by using the at least one print cylinder. See the accompanying Figure showing a schematic representation of an embodiment of the method according to the present invention.

The software used in the steps b) and c) is thereby preferably identical. Accordingly the present method uses a resolution reduced electronic data set for controlling a digital printer as well as for creating a print cylinder/a print cylinder set and the use thereof in a gravure printing process for décor coating a further carrier material. Thus, an adaptation of the resolution and optionally of the color of the prints starting from the same digital data set takes place.

The first print décor applied by digital printing and the second print décor applied by gravure printing are preferably identical so that a direct comparison of the print quality is provided. Thus it is possible to present a test sample with a specific décor produced by digital printing to a costumer and to transfer said print décor after approval by the customer to the mass production by means of the cheaper gravure printing without quality loss.

Figure 1:
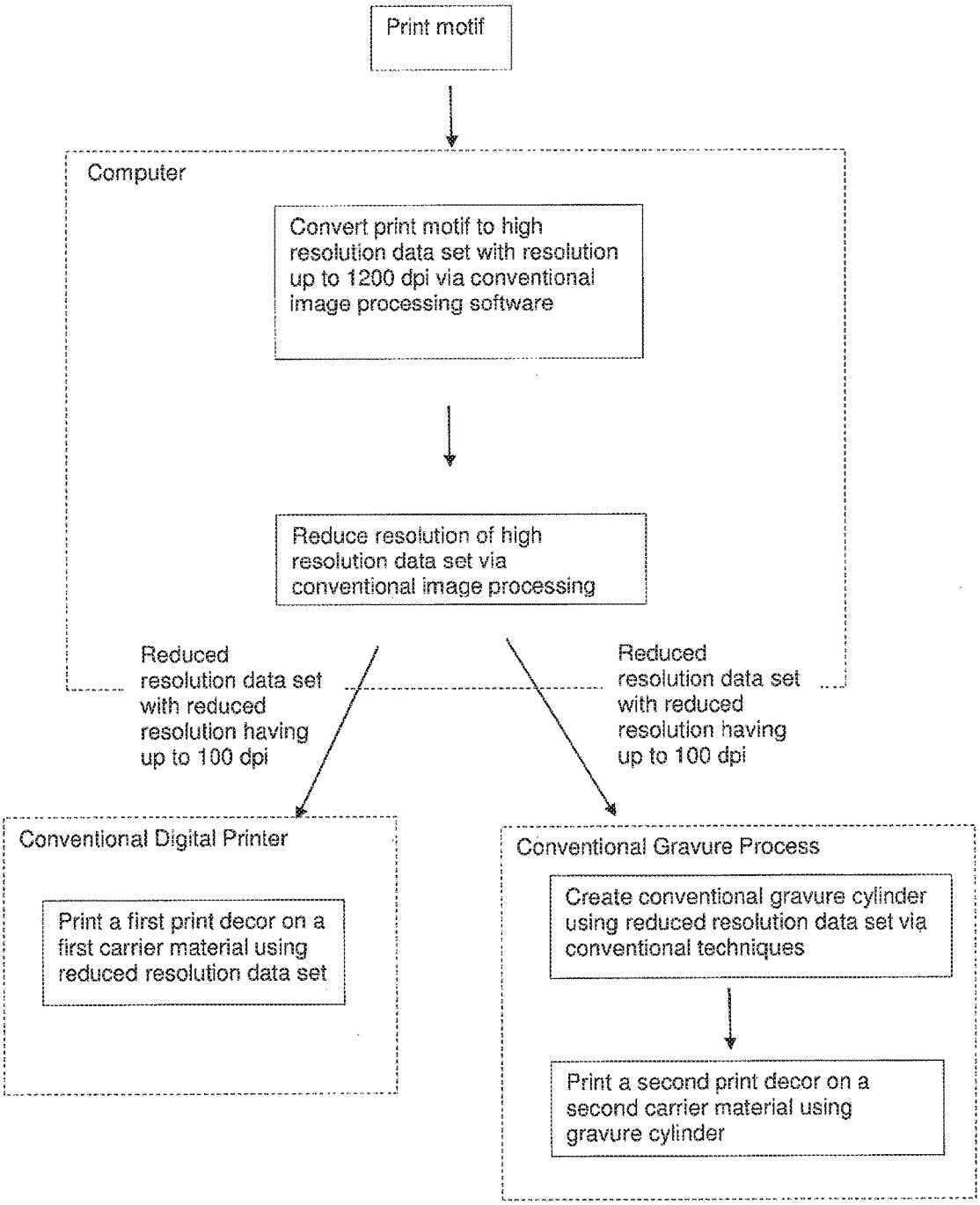
FIG. 1 is a schematic view of a method for producing decorative prints according to an embodiment of the present invention.
Figure 2:
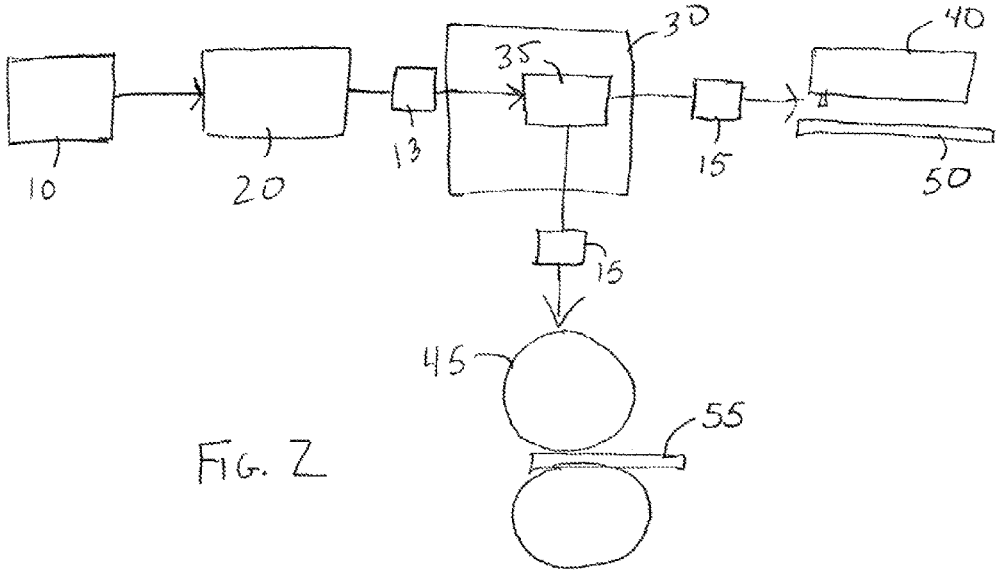
FIG. 2 is an alternative schematic view of a method for producing decorative prints according to an embodiment of the present invention.

Referring now to FIG. 2, an embodiment of process according to the present invention is illustrated. First a print motif 10 is scanned into a scanner 20 to convert the print motif 10 into a high resolution electronic data set 13. The high resolution electronic data set 13 may then be transferred to an image processing software 35 located on a computer 30, which is used to reduce the resolution of the high resolution electronic data set 13 to create a reduced resolution electronic data set 15. The reduced resolution electronic data set 15 is then sent to a digital printer 40 to print a first print décor from the reduced resolution electronic data set 15 on a first carrier material 50. The reduced resolution electronic data set 15 can also be used to create a gravure cylinder 45. The gravure cylinder 45 can then be used to print a second print décor on a second carrier material 55 through a gravure printing process using the gravure cylinder 45, which was created with the reduced resolution electronic data set 15.

Figure 3:
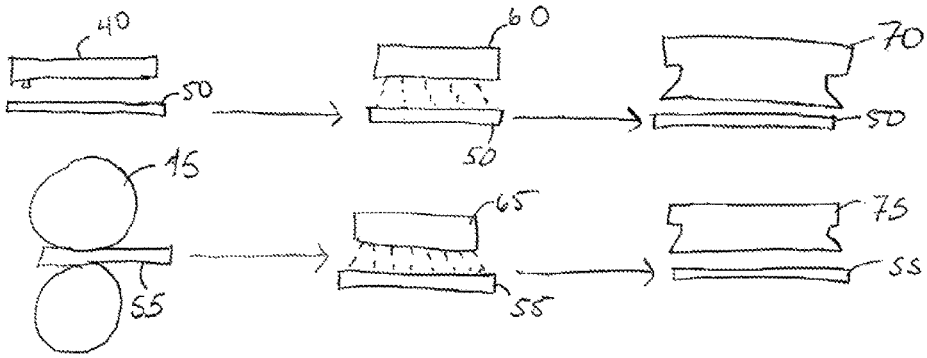
FIG. 3 is a schematic view of an embodiment of optional additional steps of the method of FIG. 2.

As illustrated in FIG. 3, the first and second carrier materials 50, 55 with printed decors from the digital printer 40 and gravure cylinder 45, respectively, may then be further processed by receiving a protective layer from a means for applying a protective layer 60, 65. Even further processing may occur, wherein the first and second carrier materials 50, 55 now having a protective layer, can be pressed by short cycle presses 70, 75. Although the processes shown herein in FIG. 3 are depicted as having separate means for applying a protective layer 60, 65 and separate short cycle presses 70, 75 for the first and second carrier materials 50, 55, respectively, it is contemplated that the process may also include a single means for applying a protective layer and/or a single short cycle press for processing the first and second carrier materials 50, 55 from both the digital printer 40 and gravure cylinder 45 lines, respectively.

As mentioned above at first a print motif is provided, wherein typically different decors as for instance veneers with wood grains, tile patterns, parquet imitations or fantasy patterns can be used as print motifs.

In a variant of the present method the at least one print motif is processed by the at least one image processing software not only into an electronic data set but is also simultaneously processed for adjusting the motif beginning and motif ending by forming a continuous motif.

It is also possible to adapt the high resolution data set of the print motif or print décor and/or to color changes. Thereby for instance markers can be applied as processing aids as for instance cutting or identification marks of non-visible ink, as IR ink, which can be read by means of appropriate detection devices. Of course also further changes or adaptations of the print motif can take place by changing or amending the data set.

The high resolution electronic data set created in step b) can be used for digital printing and comprises data for controlling the digital print. An application of such a high resolution data set in an analog method as for instance the gravure printing process however would not be possible.

Accordingly it is necessary to reduce the resolution of the at least one high resolution electronic data set according to step c) by using at least one image processing software such that the data set can be used for engraving print cylinders.

The at least one first carrier material and the at least one second carrier material used in the present method can be the same or different and can be selected from a group consisting of paper, glass, metal, films, wood products, in particular MDF or HDF boards, veneers, varnish layers, plastic boards and inorganic carrier boards.

In a preferred embodiment of the present method, the number of pixels per unit area applied by means of digital printing to the first carrier material is equal to the number of pixels per unit area applied by means of gravure printing to the second carrier material. Accordingly, it is preferred, if the number of pixels per unit area applied to the carrier material is independent on the applied printing method, i.e., it makes no difference if digital printing or gravure printing are used.

In a further variant of the present method the printing décor created by means of digital printing and the printing décor created by means of gravure printing using the print cylinder are printed on an evenly pre-primed carrier materials.

The carrier materials can be pre-treated for instance with a primer layer of a resin and/or a lacquer. Thereby, an aqueous resin solution and/or a radiation curable filling compound can be applied for priming to the side of the carrier material to be printed. For instance, aqueous formaldehyde containing resin solutions such as melamine formaldehyde resin, urea formaldehyde resin or melamine urea formaldehyde resin can be used as priming means. It is also possible to pre-coat or to prime the carrier material with UV-filler and/or ESH-filler and to cure subsequently said priming layer.

As described, in a further preferred variant of the present method at first a data set with reduced resolution is used for the digital printing as well as also for creating the cylinder set as so called standard data set. Subsequently, the décor data set can be provided electronically with individualizations, as for instance for wood decors with knotholes or cracks, for stone decors with fossilizations or inclusions or for phantasy decors with figures or toys.

Said individualized décor data set can be used either in a high resolution or in a reduced resolution for the digital printing. The question, with which resolution the individualized data set is used, depends essentially on the fact how the collections are positioned or if eventually a higher sales revenue can be obtained by individualization. Thus, the customer could be offered in case of a higher sales revenue the additional benefit of a higher resolution. If the product on the other side is to be offered as cost-efficient as possible, a reduced resolution of the data set is preferably chosen. The performance of the printer decreases significantly with higher resolution.

In the production line it is then possible to create mixed print decors. Thus, a pre-determined number of boards, for instance five boards, can be printed using the standard data set in gravure printing and a subsequent number of further boards, for instance two boards, can be printed using the individualized data set by digital printing. Thereby, it is possible to react to customer wishes and also better prices can be obtained with the individualized decors.

In a further variant of the present method, the print liquids used for digital printing and for gravure printing contain identical pigments, whereby solvent and binder of the print liquids to be used can be different. The print colors for the gravure printing and the inks for the digital printing method have accordingly the same pigment basis, which provide comparable or identical results during printing.

It is also possible to apply at least one protective layer to the décor or decors, in particular a protective layer comprising abrasion-resistant particles, natural fibers, synthetic fibers and/or further additives, wherein resins such as melamine formaldehyde resin, or urea formaldehyde resin, acrylate resins and polyurethane resins can be used as suitable binders.

The abrasion-resistant particles are preferably selected from the group containing aluminumoxide, korund, borcarbide, siliciumdioxide, siliciumcarbide and glass beads. As natural and/or synthetic fibers, in particular fibers selected from the group containing wood fibers, cellulose fibers, wool fibers, hemp fibers and organic or inorganic polymer fibers are used.

As additives conductive substances, flame retardants, luminescent compounds and metals can be added. Thereby, the conductive substances can be selected from the group containing carbon black, carbon fibers, metal powder and nanoparticles, in particular carbon nanotubes. Also, a combination of these substances can be used. As flame retardants preferably phosphates, borates, in particular ammoniumpolyphosphate, tris(tri-bromneopentyl)phosphate, zincborate or boric acid complexes of multivalent alcohols can be used. As luminescent compounds preferably fluorescent and/or phosphorescent compounds on an inorganic or organic basis, in particular zinc sulfide and of earth alkali aluminates can be used.

In a further embodiment of the present method the printed carrier material, which is optionally provided with a protective layer, is further processed or refined in a short cycle (KT) press. In the KT-press the resin layers are melted and the layer composite is hardened to a laminate.

During the further processing in the KT-press surface structures can also be created in the surface of the carrier material, such as a wood based board, using a structured press plate, wherein the surface structures can be optionally implemented matching the décor (so-called décor synchronic structure). In case of wood decors, the structures can be present in form of pore structures, which follow the grain. In case of tile decors the structures can be depressions in the area of grove lines comprised by the décor.

The present method offers multiple advantages. The sorted and selected carrier materials provided with printing decors can be immediately presented to the costumer. It is possible to create any color positions as well as to introduce a digital finishing work. The decors or products with the corresponding decors can also be produced in any amount and a fast delivery is possible without creating print cylinders. The use of the master data set for premium products using the data set with highest resolution is also possible and remaining stocks of different value added levels are avoided.

The presently described method has the advantage that a fast supply of products with adapted colors is possible and only later depending on the market success of the product the best production method can be selected. The disadvantage of higher cost is limited to the poorly selling decors or initial productions. Furthermore, the development of decors within the product life circle can be better considered. Thus, a small amount is digitally printed for sorting or presentation of photo type samples and the large amounts resulting therefrom are subsequently produced by gravure printing. At the end of the life cycle of a product small amounts can again be produced digital. The further advantage is that in a production line, which comprises the possibilities of gravure printing as well as digital printing a décor can be processed in a manner that individualized and non-individualized are mixed.

The present method is carried out in a device for producing decor prints with identical quality on at least two carrier materials from a starting data set, wherein the device comprises the following elements:

- at least one means, for instance an image processing software, for converting at least one print motif into at least one high resolution electronic data set with a resolution of up to 1200 dpi, preferably 1000 dpi;
- at least one means, for instance an image processing software, for reducing the resolution of the at least one high resolution electronic data set down to 100 dpi, preferably 60 to 80 dpi,
- at least one first printing line with a digital printer for creating at least one first print décor on at least one first carrier material and the use of the at least one resolution reduced electronic data set, and
- at least one second printing line with a print cylinder for a gravure printing process for creating at least one second print décor on at least one second carrier material, wherein the at least one print cylinder was created by using at least one resolution reduced electronic data set, and wherein the resolution reduced electronic data set can be the same or different from the resolution reduced electronic data set reduced for the digital printing in the first printing line.

As previously described for the method the used carrier material can be the same or different.

Print liquids with the same pigment basis can also be used in the first and second printing line for the gravure printing and the digital printing, i.e. the used print liquids can comprise identical pigments.

In a further variant the present device comprises at least one means for applying a protective layer to the carrier material provided with the respective print decor. Said means or device for applying a protective layer is arranged preferably subsequently to the first printing line or the second printing line.

In a preferred embodiment the present device comprises at least one short cycle press for pressing the carrier material provided with a print decor and the protective layer arranged thereon. Hereby at least one short cycle press can be assigned to each printing line or it is also conceivable that the carrier materials leaving the first and the second printing line and provided with the respective print decor can be fed to a single short cycle press.

The invention is subsequently described with reference to an example.

EXAMPLE

A veneer (1400×2070 mm) is scanned in a scanner with a resolution of 1000 dpi.

By adjusting using an image processing software the transition at the beginning and the end of the decor can be aligned so that an endless decor is obtained.

The processing of wood grains can be also carried out or elements for individualization such as knotholes, cracks and so on can be integrated.

Furthermore, cutting, identification markers or other processing means can be applied. They can be realized also with non-visible inks (IR ink) in case of the digital printing, which are recognized later by appropriate detection devices.

The electronic data set is subsequently reduced by the image processing software to a resolution, which is suitable for the engraving of print cylinders (60-80 dpi).

First samples are than created on a digital printer using this data set, which can still be adapted in color after consultation. Papers, films, wood boards, veneers, lacquer layers, plastic boards, inorganic carrier boards and so on can thereby be used for the prints as carrier materials.

In parallel cylinders are created for the production of the decor in gravure printing process using the data set.

Subsequently the decors, which can be realized by gravure printing and digital printing, are printed onto evenly preprimed carriers. A mixed print can thereby be carried out when using carrier boards. The standard data set is created in gravure printing and the individualized data set is produced by the digital printer. Thus it is possible to produce a floor for costumer, which consists of a mixture of standard and individual panels based on a floor.

The method is not limited to the production of wood reproductions. Any template can be digitalized, processed and printed or pressed to the different carrier materials.

The invention claimed is:

1. A method for producing decorative prints having identical quality on at least two carrier materials selected from MDF or HDF boards comprising the following steps:

a) providing at least one print motif;

b) converting the at least one print motif into at least one high resolution electronic data set having a resolution of up to 1200 dpi, preferably 1000 dpi, by at least one image processing software, c) reducing the resolution of the at least one high resolution electronic data set down to 100 dpi, preferably 60 to 80 dpi, to create a reduced resolution electronic data set by at least one image processing software, d) printing via a digital printer at least one first print decor from the reduced resolution electronic data set on at least one first carrier material, e) engraving at least one print cylinder for a gravure printing process using the reduced resolution electronic data set, and f) printing at least one second print decor on at least one second carrier material through the gravure printing process by using the at least one print cylinder.

2. The method according to claim 1, wherein the at least one print motif is processed by the at least one image processing software for adjusting the motif beginning and motif end by forming a continuous motif.

3. The method according to claim 1, wherein the at least one high resolution electronic data set comprises a color adjusted and/or decor adjusted data set.

4. The method according to claim 1, wherein the at least one first carrier material and the at least one second carrier material are the same or different.

5. The method according to claim 1, wherein the number of pixels per unit area applied via digital printing to the first carrier material is equal to the number of pixels per unit area applied through gravure printing to the second carrier material.

6. The method according to claim 1, wherein the print decor printed via digital printing and the print decor printed through the gravure printing process using the print cylinder are printed onto evenly pre-primed carrier materials.

7. The method according to claim 1, wherein an electronic standard data set is generated for gravure printing via the print cylinder and an electronically individualized data set is created for digital printing.

8. The method according to claim 1, wherein print liquids used on the first decor and the second decor contain identical pigments.

9. The method according to claim 1, wherein a protective layer is applied to the print decor or the print decors.

10. The method according to claim 1, wherein the printed carrier material is further processed in a short cycle press.

11. A device for producing decor prints having identical quality on at least two carrier materials selected from MDF or HDF boards from a starting data set comprising at least one means for converting at least one print motif into at least one high resolution electronic data set with a resolution of up to 1200 dpi, preferably 1000 dpi;

at least one means for reducing the resolution of the at least one high resolution electronic data set down to 100 dpi, preferably 60 to 80 dpi, to create a reduced resolution electronic data set, at least one first printing line with a digital printer for creating at least one first print decor on at least one first carrier material by using the reduced resolution electronic data set, and at least one second printing line with a print cylinder for a gravure printing process for creating at least one second print decor on at least one second carrier material, wherein the at least one print cylinder was engraved using the reduced resolution electronic data set.

12. The device according to claim 11, wherein the first and the second printing line use print liquids with the same pigment basis.

13. The device according to claim 11, further comprising at least one means for applying a protective layer to the carrier material provided with the respective print decor.

14. The device according to claim 11, further comprising at least one short cycle press for pressing the carrier material provided with the decor and the protective layer arranged thereon.

15. The method of claim 10, wherein the printed carrier material is provided with a protective layer.

16. The method of claim 10, wherein surface structures are created in the short cycle press.

17. A method for producing decorative prints having identical quality on at least two carrier materials from MDF or HDF boards comprising the following steps:

a) providing at least one print motif electronic data set having a reduced resolution of up to 100 dpi representing a print motif, b) printing via a digital printer at least one first print decor from the reduced resolution print motif electronic data set on at least one first carrier material, c) engraving at least one print cylinder for a gravure printing process using the reduced resolution print motif electronic data set, and d) printing at least one second print decor on at least one second carrier material through the gravure printing process by using the at least one print cylinder, wherein the reduced resolution print motif electronic data set is an image processing software reduced data set reduced from a high resolution print motif electronic data set of up to 1200 dpi representing the print motif.

* * * * *